US011751318B2

(12) United States Patent
Liu et al.

(10) Patent No.: US 11,751,318 B2
(45) Date of Patent: Sep. 5, 2023

(54) SOFT X-RAY LIGHT SOURCE

(71) Applicant: RAYCAN Technology Co., Ltd. (Suzhou), Jiangsu (CN)

(72) Inventors: Wei Liu, Jiangsu (CN); Rui Zheng, Jiangsu (CN); Qingguo Xie, Jiangsu (CN); Peng Xiao, Jiangsu (CN)

(73) Assignee: RAYCAN TECHNOLOGY CO., LTD. (SUZHOU)

( * ) Notice: Subject to any disclaimer, the term of this patent is extended or adjusted under 35 U.S.C. 154(b) by 235 days.

(21) Appl. No.: 17/309,899

(22) PCT Filed: Oct. 29, 2019

(86) PCT No.: PCT/CN2019/113890

§ 371 (c)(1),
(2) Date: Jun. 28, 2021

(87) PCT Pub. No.: WO2020/134500

PCT Pub. Date: Jul. 2, 2020

(65) Prior Publication Data

US 2022/0030692 A1 Jan. 27, 2022

(30) Foreign Application Priority Data

Dec. 29, 2018 (CN) ..... 201811640371.0

(51) Int. Cl.
*H05G 2/00* (2006.01)

(52) U.S. Cl.
CPC ..... *H05G 2/003* (2013.01); *H05G 2/006* (2013.01); *H05G 2/008* (2013.01)

(58) Field of Classification Search
CPC ..... H05G 2/003; H05G 2/006; H05G 2/008
See application file for complete search history.

(56) References Cited

U.S. PATENT DOCUMENTS 6,065,203 A * 5/2000 Haas ..... H05G 2/003 29/505
2002/0051358 A1* 5/2002 Haas ..... H05G 2/008 362/96

(Continued)

FOREIGN PATENT DOCUMENTS

CN 1728915 A 2/2006
CN 101111119 A 1/2008

(Continued)

OTHER PUBLICATIONS

Foreign communication from the priority International Application No. PCT/CN2019/113890 PCT, International Search Report, 5 pages.

(Continued)

*Primary Examiner* — Chih-Cheng Kao
(74) *Attorney, Agent, or Firm* — KLEMCHUK PLLC

(57) ABSTRACT

A soft X-ray light source, including a vacuum target chamber, a refrigeration cavity, and a nozzle. The refrigeration cavity and the nozzle are contained in the vacuum target chamber. The nozzle (36) is arranged in the refrigeration cavity. The vacuum target chamber has a t-branch tube and a multi-channel tube. The t-branch tube has a first outlet and a second outlet opposed to each other and a third outlet, wherein the first outlet is connected to a mounting plate through which a refrigerant inlet pipe, a refrigerant outlet pipe, and a working gas pipe respectively pass and are connected to the refrigeration cavity, and wherein the third outlet is connected to a vacuum extraction device. The multi-channel tube has a top opening and a bottom opening opposed to each other, wherein the top opening is connected to the second outlet, wherein a vacuum outlet is provided at the bottom opening.

17 Claims, 5 Drawing Sheets

(56) References Cited

U.S. PATENT DOCUMENTS

| | | | | |
|---|---|---|---|---|
| 2005/0115333 | A1* | 6/2005 | Fujimoto | H05G 2/003 73/861 |
| 2007/0053487 | A1 | 3/2007 | Yoon et al. | |

FOREIGN PATENT DOCUMENTS

| | | | |
|---|---|---|---|
| CN | 103234481 | A | 8/2013 |
| CN | 109640500 | A | 4/2019 |
| CN | 109696447 | A | 4/2019 |
| CN | 209659696 | U | 11/2019 |
| CN | 209659697 | U | 11/2019 |

OTHER PUBLICATIONS

Foreign communication from the priority International Application No. PCT/CN2019/113890 PCT, Written Opinion of the International Searching Authority, 6 pages.

* cited by examiner

SOFT X-RAY LIGHT SOURCE

CROSS-REFERENCE TO RELATED APPLICATIONS

This application is a filing under 35 U.S.C. 371 of International Application No. PCT/CN2019/113890, filed Oct. 29, 2019, entitled "Soft X-Ray Light Source," which claims priority to Chinese Patent Application No. 201811640371.0 filed Dec. 29, 2018, which applications are incorporated by reference herein in their entirety.

TECHNICAL FIELD

The invention relates to the field of soft X-rays, and more specifically to a soft X-ray light source.

BACKGROUND

X-ray is a kind of electromagnetic radiation with a very short wavelength in a range of about 0.01-100 angstroms, which is between ultraviolet and gamma rays. X-ray represents high penetration capacity and is able to penetrate various materials that are opaque to the visible light. X-rays with shorter wavelengths represent greater energy and are also known as hard X-rays. X-rays with longer wavelengths represent lower energy and are known as soft X-rays. Generally speaking, with a wavelength less than 0.1 angstroms, the X-ray is known as super-hard X-ray, with the wavelength in the range of 0.1-10 angstroms as hard X-ray, and with the wavelength in the range of 10-100 angstroms as soft X-ray.

In recent years, soft X-rays have been widely used in many scientific fields. Especially in the fields of soft X-ray microscopic imaging and soft X-ray projection lithography technologies, soft X-rays with low debris, high brightness, and high stability are increasingly needed. In addition, in atomic spectroscopies, molecular spectroscopies, plasma physics or other subjects, soft X-ray light sources are typically indispensably required by scientific experiments, therefore, the demands for the applications of soft X-ray light sources have been rapidly increased.

In the early stage, the laser-plasma soft X-ray light source adopts a solid metal target, which will produce a lot of metal debris which may in turn damage the optics adjacent to the light source, such that it is unable to perform normal functions, and the effect is greatly degraded, leading to the incapability of normal operation of the light path in the experiments or the instruments. With the development of the technologies, therefore, liquid microfluidic targets have begun to be widely used. In the prior art, gas liquefaction is mainly realized by contacting a semiconductor refrigeration device with a pipe through which working gas passes. There are two shortcomings in this kind of refrigeration device: First, the refrigeration capacity of the semiconductor refrigeration device cannot reach the level of liquefying some working gases with a low liquefaction point (for example, nitrogen with a liquefaction point −196° C. under the normal pressure), even under high pressure. Second, the refrigeration device does not represent high efficiency in that the use of contact between a spiral gas pipe and the metal heat conductive plate of the semiconductor refrigeration sheet does not represent a high heat transfer efficiency, which results in an inconsistency between the temperature in the gas pipe and that of the refrigeration sheet. For most working gases with a low liquefaction point, even after successful liquefaction, nitrogen crystallization will occur due to the evaporation and condensation effect, making it difficult to maintain a stable jet of low-temperature liquid flow.

Meanwhile, in the prior art solutions, there is no dedicated collection device for the liquid micro-flow. Instead, only an empty pump pipe is connected to the bottom of the cavity directly below the vertical position of the liquid flow, such that the vacuum degree in the vacuum target chamber cannot be maintained at a high level. Since the soft X-ray is of low-energy X-ray with a long wavelength and strong absorption in the air, the lack of vacuum in the vacuum target chamber will cause the soft X-rays generated by the laser-plasma to be partially absorbed, and thus the light intensity of the light will be weakened.

In addition, in the prior art solutions, the liquid microfluidic target devices of fixed and non-adjustable structure are provided, in which the position of the nozzle is fixed and non-adjustable after installation. However, various applications of soft X-rays, such as soft X-ray microscopes, require a light source of high-degree geometric symmetry. If there is a manufacturing error of the light source device or an offset of the nozzle position due to the aging of the instrument, it will directly affect the application of the instrument with reduced application performance.

In short, the soft X-ray light source of liquid microfluid target laser plasma in the prior art has shortcomings of insufficient refrigeration performance of the liquid microfluid target, poor liquid flow stability, and poor performance in terms of size, spatial stability, and brightness of the laser-plasma or the like, which may not meet the application requirements.

SUMMARY

The object of the invention is to provide a soft X-ray light source, which is able to solve at least one of the above-mentioned technical problems.

To address the above-mentioned technical issues, in the disclosure a soft X-ray light source is proposed, comprising a vacuum target chamber, a refrigeration cavity, and a nozzle, wherein the refrigeration cavity and the nozzle are received in the vacuum target chamber, and the nozzle is arranged in the refrigeration cavity, wherein the vacuum target chamber comprises a t-branch tube and a multi-channel tube. The t-branch tube has a first outlet and a second outlet opposed to each other as well as a third outlet located between the first outlet and the second outlet, wherein the first outlet is connected to a mounting plate through which a refrigerant inlet pipe, a refrigerant outlet pipe, and a working gas pipe respectively pass and are connected to the refrigeration cavity and wherein the third outlet is connected to a vacuum extraction device. The multi-channel tube comprises a top opening and a bottom opening opposed to each other as well as a plurality of side openings located between the top opening and the bottom opening, wherein the top opening is tightly connected to the second outlet, wherein a vacuum outlet is provided at the bottom opening, wherein the nozzle has a position corresponding to those of the side openings, wherein provided under the nozzle is a groove which is fixed by an adapter arranged at the vacuum outlet, and wherein the groove is in communication with the vacuum outlet.

According to an embodiment of the present application, arranged below the refrigeration cavity is an adapter connected to the nozzle.

According to an embodiment of the present application, a temperature sensor is provided at the nozzle.

According to an embodiment of the present application, the adapter is provided with a heat conduction rod connected to the refrigeration cavity.

According to an embodiment of the present application, the adapter is provided with a heat conduction tube in communication with the refrigeration cavity.

According to an embodiment of the present application, the groove is provided on a top portion of a frustum fixedly connected to the adapter.

According to an embodiment of the present application, a heater, such as a resistance wire, is provided at the periphery of the nozzle.

According to an embodiment of the present application, the soft X-ray light source comprises a mounting plate, a bellows, and a three-dimensional displacement mechanism. The mounting plate is arranged above the vacuum target chamber and is provided with a refrigerant inlet pipe, a refrigerant outlet pipe, and a working gas pipe passing through the mounting plate, wherein the refrigerant inlet pipe and the refrigerant outlet pipes are in communication with the refrigeration cavity, and the working gas pipe passes through the refrigeration cavity and is connected to the nozzle. The bellows is arranged between the mounting plate and the vacuum target chamber, wherein the refrigerant inlet pipe, the refrigerant outlet pipe, and the working gas pipe all pass through the bellows. The three-dimensional displacement mechanism is arranged between the mounting plate and the vacuum target chamber.

According to an embodiment in the disclosure, the three-dimensional displacement mechanism comprises a first displacement adjuster, a second displacement adjuster, and a third displacement adjuster, which are arranged between the mounting plate and the vacuum target chamber and respectively, control the movements of the mounting plate in three mutually perpendicular directions.

According to an embodiment of the present application, the soft X-ray light source further comprises a first mounting plate, a second mounting plate, and a third mounting plate arranged in parallel with each other and sleeved about the bellows, wherein the first mounting plate is movably fastened to the mounting plate by the third displacement adjuster, the second mounting plate is movably fastened to the first mounting plate by the second displacement adjuster and is movably fastened to the third mounting plate by the first displacement adjuster, and third mounting plate fastened to the vacuum target chamber.

According to an embodiment of the present application, the first displacement adjuster comprises a first bracket fastened to the third mounting plate, a first pusher fastened to the first mounting plate and aligned with the second mounting plate, a first rail fastened to the third mounting in a first direction, and a first rail groove fastened to the underside of the second mounting plate and in slidable cooperation with the first rail.

According to an embodiment of the present application, the second displacement adjuster comprises a second bracket fastened to the second mounting plate, a second pusher fastened to the second mounting plate and aligned with the first mounting plate, a second rail fastened to the second mounting in a second direction perpendicular to the first direction, and a second rail groove fastened to the underside of the first mounting plate and in slidable cooperation with the second rail.

According to an embodiment of the present application, the first displacement adjuster comprises a plurality of screws fastened to the first mounting plate and evenly arranged in a third direction perpendicular to the first direction and the second direction, and a plurality of nuts, wherein the mounting plate is fastened to the screws by engagement of the nut and the screws.

According to an embodiment of the present application, the first displacement adjuster may have a plurality of stepping devices arranged in a third direction perpendicular to the first direction and the second direction, wherein the mounting plate is fastened to the first mounting plate by the stepping devices.

According to an embodiment of the present application, the first pusher or the second pusher may have a micrometer head.

According to an embodiment of the present application, the working gas pipe has a section forming a condensing cavity with an enlarged cross-sectional area, wherein the condensing cavity is at least partially located in the refrigeration cavity.

To address the above-mentioned shortcomings, the soft X-ray light source in the disclosure is provided with direct contact between the refrigerant in the refrigeration cavity and the through pipe through which the working gas passes, for the purpose of cooling. The refrigeration effect may be adjusted upon the selection of refrigerants, which for example may reach an extremely low temperature and thus liquefy the working gas having a relatively low liquefaction point, such as liquid nitrogen. The heating is performed at the outlet of the nozzle by means of the resistance wire around the periphery of the nozzle, in order to improve the stability of the liquid flow. Meanwhile, in the disclosure, a multi-channel vacuum system is proposed, in which the metal frustum under the nozzle is cooperation with the vacuum pump pipelines to prevent the low-temperature micro-flow from further vaporizing during the flow process which will otherwise reduce the vacuum degree and cause the consumption of soft X-rays, while a further set of vacuum pumps is arranged above the cavity of the vacuum target chamber for extraction of the gas in the cavity so as to maintain a high-degree vacuum in the cavity. In addition, the device is provided with such a three-dimensional displacement mechanism to adjust the position of the nozzle in the X-axis, Y-axis, and Z-axis directions, thereby realizing the adjustment of the geometric position of the light source.

BRIEF DESCRIPTION OF THE DRAWINGS

The accompanying drawings with reference to the embodiments or state of art will be described for the purpose of demonstrating the embodiments in the disclosure and the state of art. It is apparent that the drawings as shown are merely illustrative of some embodiments as recited in the disclosure. It should be understood by those skilled in the art that various alternatives to the drawings as shown may be appreciated, without creative work involved.

DETAILED DESCRIPTION

In the following, the application will be described further with reference to embodiments. It should be understood that the following embodiments are only for illustrative instead of limited purposes.

Notably, when a component or element is referred to as being "disposed on" another component or element, it can be directly disposed on the other component or element or there may be an intermediate component or element. When a component or element is referred to as being "connected or coupled" to another component or element, it may be directly connected or coupled to the other component or element or there is an intermediate component or element. The term "connection or coupling" used herein may include electrical connection or coupling and/or mechanical or physical connection or coupling. The term "comprise or include" used herein refers to the existence of features, steps, components or elements, but does not exclude the existence or addition of one or more further features, steps, components, or elements. The term "and/or" used herein includes any and all combinations of one or more of the related listed items.

Unless otherwise indicated, all the technical and scientific terms used herein have general meaning as commonly understood by those skilled in the technical field related to the disclosure. The terms used herein are for the purpose of describing specific embodiments, but not intended to limit the invention.

In addition, the terms "first", "second", "third" or the like used herein are only for the purpose of description and to distinguish similar objects from each other, which do not express the sequence thereof, nor can they be understood as an indication or implication of relative importance. In addition, in the description in the disclosure, unless otherwise specified, "a plurality of" means two or more.

Figure 1:
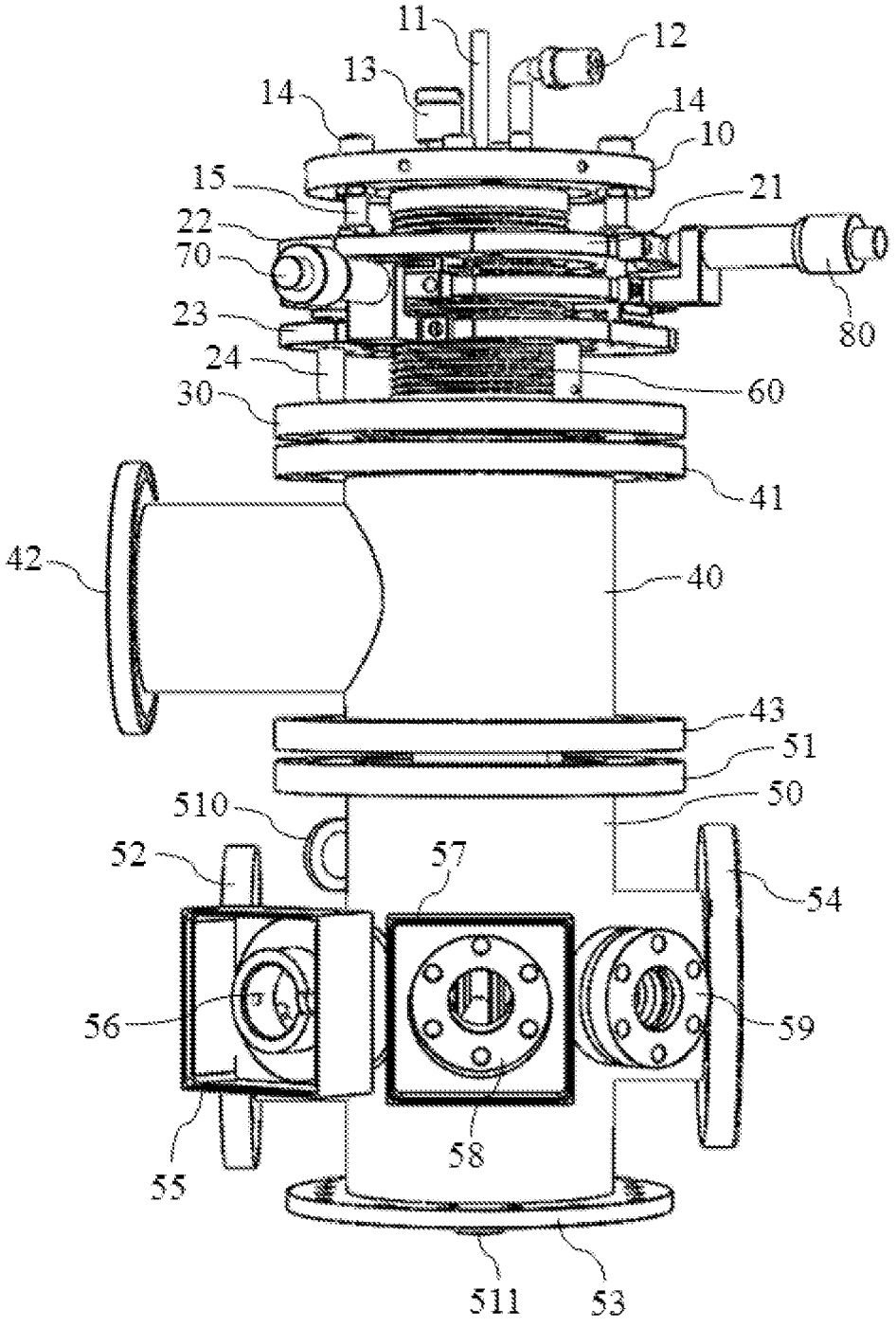
FIG. 1 is a schematically perspective view of a soft X-ray light source according to an embodiment in the disclosure.

FIG. 1 is a three-dimensional schematic diagram of a soft X-ray light source according to an embodiment of the present application. It can be seen from FIG. 1 that the soft X-ray light source provided in the present application comprises a three-dimensional displacement mechanism, a vacuum target chamber, a refrigeration mechanism, and a light-generating mechanism, which will be described in detail with reference to the drawings.

In FIG. 1, the three-dimensional displacement device comprises a mounting plate 10 in a shape of a plate, a bellows 60, a first flange 30, a first displacement adjuster 70, a second displacement adjuster 80, and a third displacement adjuster 14. The bellows 60 has a cylindrical shape and is configured to be expandable and collapsible in an axial direction thereof. The bellows 60 has a sealed top portion arranged on a lower surface of the mounting plate 10, and a bottom portion tightly connected to the first flange 30, such that the mounting plate 10, the bellows 60, and the first flange 30 form a closed, substantially cylindrical space. The cylindrical space has a vertical centerline, which is the direction vertical to the paper showing the figure, defined as the Z-axis direction, and two mutually perpendicular directions in a plane perpendicular to the Z-axis direction defined as the X-axis and Y-axis directions, respectively. The first flange 30 is provided with a plurality of first screws 24 extending in the Z-axis direction. Arranged on top portions of the first screws is an annular third mounting plate 23 which is provided with the first displacement adjuster 70. Provided is a second mounting plate 22 having the same shape as and parallel to the third mounting plate 23. The second mounting plate 22 is positioned above the third mounting plate 23 and is connected to the third mounting plate 23 by means of the first displacement adjuster 70. The second mounting plate 22 is provided with a second displacement adjuster 80. The first mounting plate 21 has the same shape as and is parallel to the second mounting plate 22. The first mounting plate 21 is positioned above the second mounting plate 22 and is connected to the second mounting plate 22 by means of the second displacement adjuster 80. The first mounting plate 21, the second mounting plate 22, and the third mounting plate 23 are substantially stacked over each other and have through holes of the same size, respectively, in which the bellows 60 is received. The first mounting plate 21 is provided a plurality of, such as three (3), second screws 15 extending in the Z-axis direction, to which the mounting plate 10 is fastened by means of an adjusting nut 14, as a third displacement adjuster, which is configured to adjust the position of the mounting plate 10 in the Z axis direction. The mounting plate 10 is also provided with a working gas pipe 11, a refrigerant outlet pipe 12, and a refrigerant inlet pipe 13, which pass through the mounting plate 10 from the outside and are inserted into the bellows 60.

Further, in FIG. 1, the vacuum target chamber comprises a t-branch tube 40 including three outlets, i.e., a top outlet, a bottom outlet, and a side outlet, and a multi-channel tube 50. Provided between the top outlet and the bottom outlet is a cylindrical space extending in the Z-axis direction, with which the side outlet is in communication. Arranged at the top outlet is a second flange 41, arranged at the side outlet is a third flange 42, and arranged at the bottom outlet is a fourth flange 43. The first flange 30 and the second flange 41 are tightly connected to each other by a gasket and a bolt. The multi-channel tube 50 comprises an upper opening, a lower opening, and a plurality of side openings. Provided between the upper opening and the lower opening is a cylindrical space extending in the Z-axis direction, with which the side openings are in communication. Meanwhile, arranged at the upper opening is a fifth flange 51, arranged at the lower opening is a sixth flange 53, and arranged at the side openings are the respective flanges 52, 54 or the like. The firth flange 51 and the fourth flange 31 are tightly connected to each other by a gasket and a bolt. The sixth flange 53 is provided with a vacuum exhaust port 511 in the central portion thereof. It should be noted by those skilled in the art that where the first flange 30 is tightly connected to the second flange 41, the cylindrical space in the bellows 60 above the first flange 30 is not in communication with the cylindrical space in the t-branch tube 40 under the second flange 41. Where the fourth flange 43 is tightly connected to the fifth flange 51, the cylindrical space in the t-branch tube 40 above the fourth flange 43 is in communication with the cylindrical space in the multi-channel tube 50 under the fifth flange 51. Arranged at the plurality of side openings on the side face of the multi-channel tube 50, there may be a CCD holder 55, a CCD adapter 56, a laser shield 57, observation windows 58, 59, or the like, which are commonly used by those skilled in the art and will not be elaborated in detail.

Figure 2:
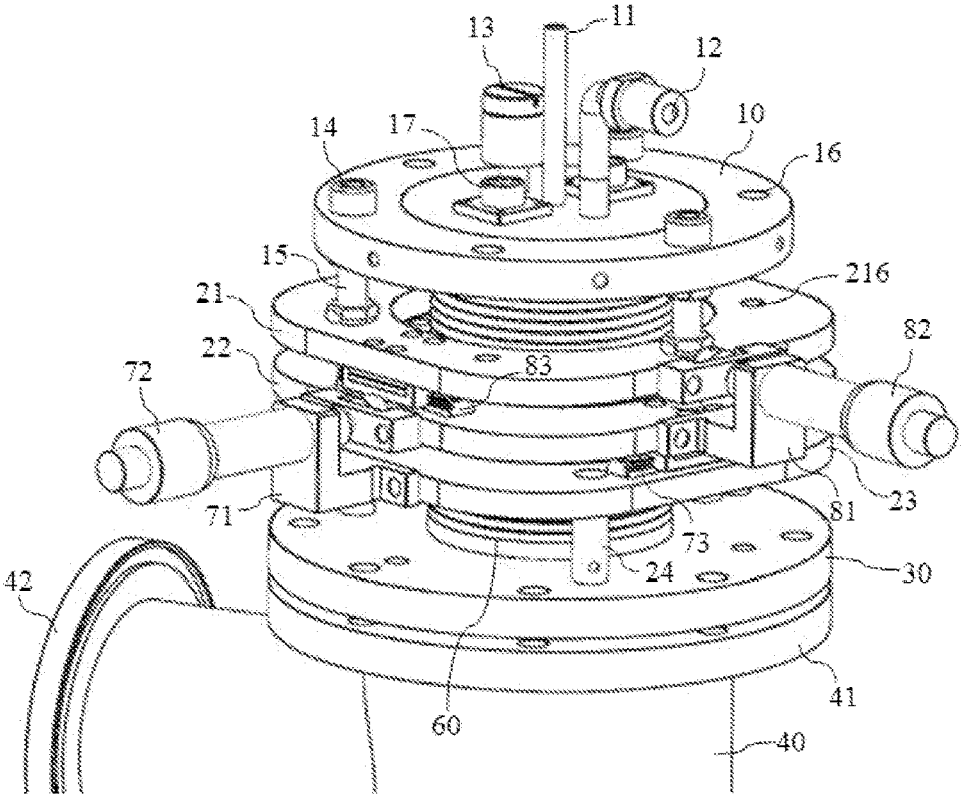
FIG. 2 is a schematically, partially enlarged perspective view of the soft X-ray light source according to FIG. 1, showing a three-dimensional displacement mechanism.
Figure 4:
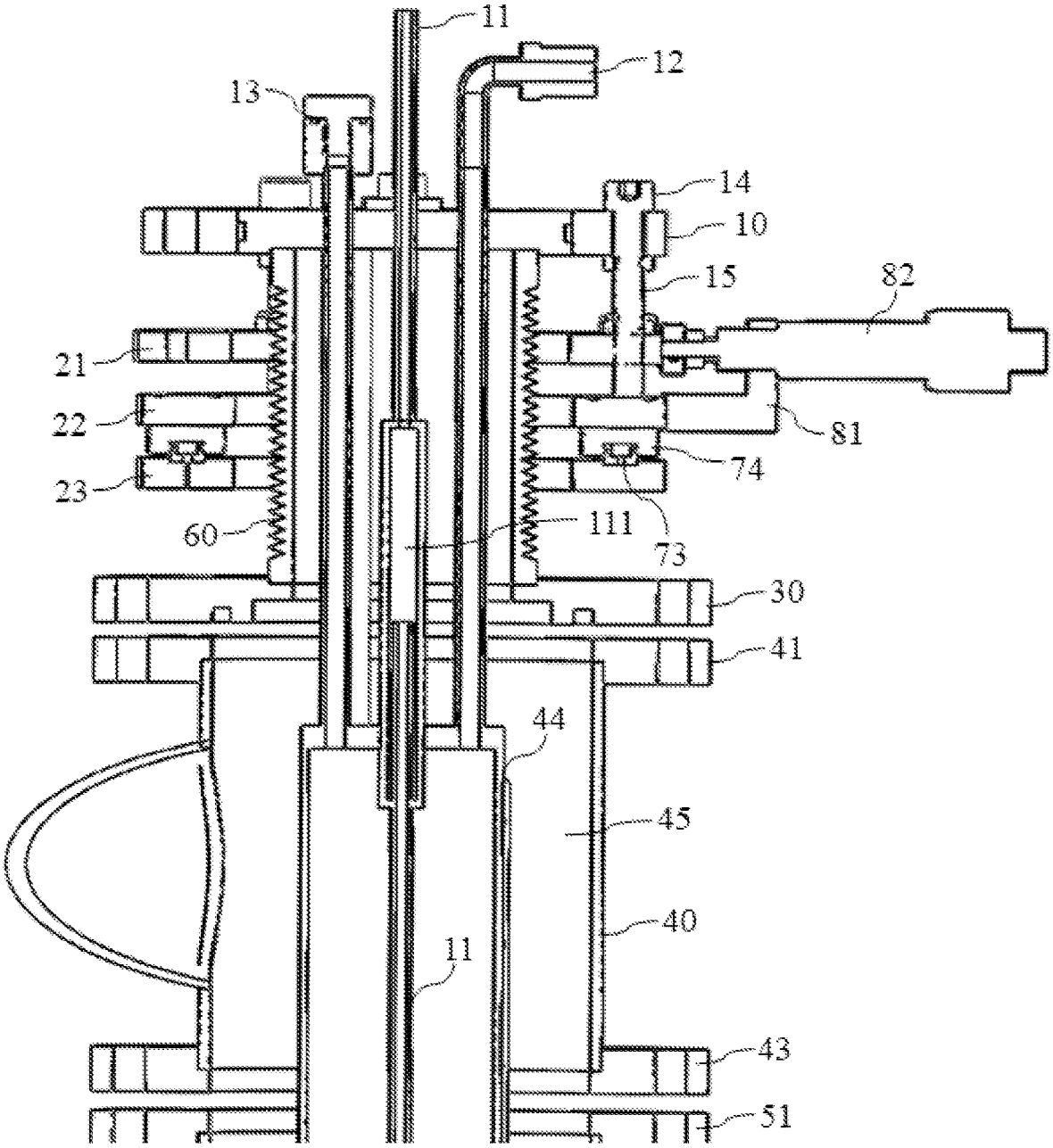
FIG. 4 is a schematically cross-sectional view of the soft X-ray light source according to FIG. 1, only with the upper portion being shown.

Further, FIG. 2 is a schematically, partially enlarged perspective view of the soft X-ray light source according to FIG. 1. As shown in FIG. 2, the first flange 30 and the second flange 41 are provided with evenly distributed bolt holes adjacent to the circumferential edge, through which the fastening bolts are inserted to form a tight connection between the first flange 30 and the second flange 41. By means of a plurality of first screws 24, the first flange 30 is fixedly connected to the third mounting plate 23, such that the latter two are not moveable relative to each other. The first displacement adjuster 70 comprises a first bracket 71, a first pusher 72, a first rail 73, and a first rail groove 74 (FIG. 4). The first bracket 71 is in form of an L shape, with one end fastened to the third mounting plate 23, and the other end protruding upwardly and perpendicular to the plane where the third mounting plate 23 is located. The first pusher 72 is arranged on the other end of the first bracket 71 in the X-axis direction and is aligned with the second mounting plate 22, such that the movement of the first pusher 72 will drive the second mounting plate 22 to move. There are two (2) first rails 73 arranged on the upper surface of the third mounting plate 23 and extending along the X-axis direction, and the two first rails 73 are arranged symmetrically with respect to the bellows 60 and are parallel to each other. The lower surface of the second mounting plate 22 is provided with the first rail grooves 74 (FIG. 4) configured to cooperate with the first rails 73. The first guide rails 73 are received in the first guide grooves 74 and are slidable along the first guide grooves 74. When the first pusher 72 is moved, the second mounting plate 22 slides along the first guide rails 73 in the X-axis direction. The second displacement adjuster 80 comprises a second bracket 81, a second pusher 82, a second rail 83, and a second rail groove. The second bracket 81 is in form of an L shape, with one end fastened to the second mounting plate 22, and the other end protruding upwardly and perpendicular to the plane where the first mounting plate 21 is located. The second pusher 82 is arranged on the other end of the second bracket 81 in the Y-axis direction and is aligned with the first mounting plate 21, such that the movement of the second pusher 82 will drive the first mounting plate 21 to move. There are two (2) second rails 83 arranged on the upper surface of the second mounting plate 22 and extending along the Y-axis direction, and the two (2) second rails 83 are arranged symmetrically with respect to the bellows 60 and are parallel to each other. The lower surface of the first mounting plate 21 is provided with the second rail grooves configured to cooperate with the second rails 83. The second guide rails 83 are received in the second guide grooves and are slidable along the second guide grooves. When the second pusher 82 is moved, the first mounting plate 21 slides along the second guide rails 83 in the Y-axis direction. The bellows 60 has a cylindrical shape and is configured to be expandable and collapsible in an axial direction thereof, the sealed top portion of the bellows 60 is arranged on the lower surface of the mounting plate 10, and the mounting plate 10 is fastened on the second screw 15 through the adjusting nut 14, such that when the first pusher 71 and the second pusher 82 are adjusted respectively, the mounting plate 10 will be moved along the X-axis direction and the Y-axis direction accordingly, and when the third displacement adjuster 14 is adjusted, the mounting plate 10 will be moved along the Z-axis direction accordingly.

Figure 3:
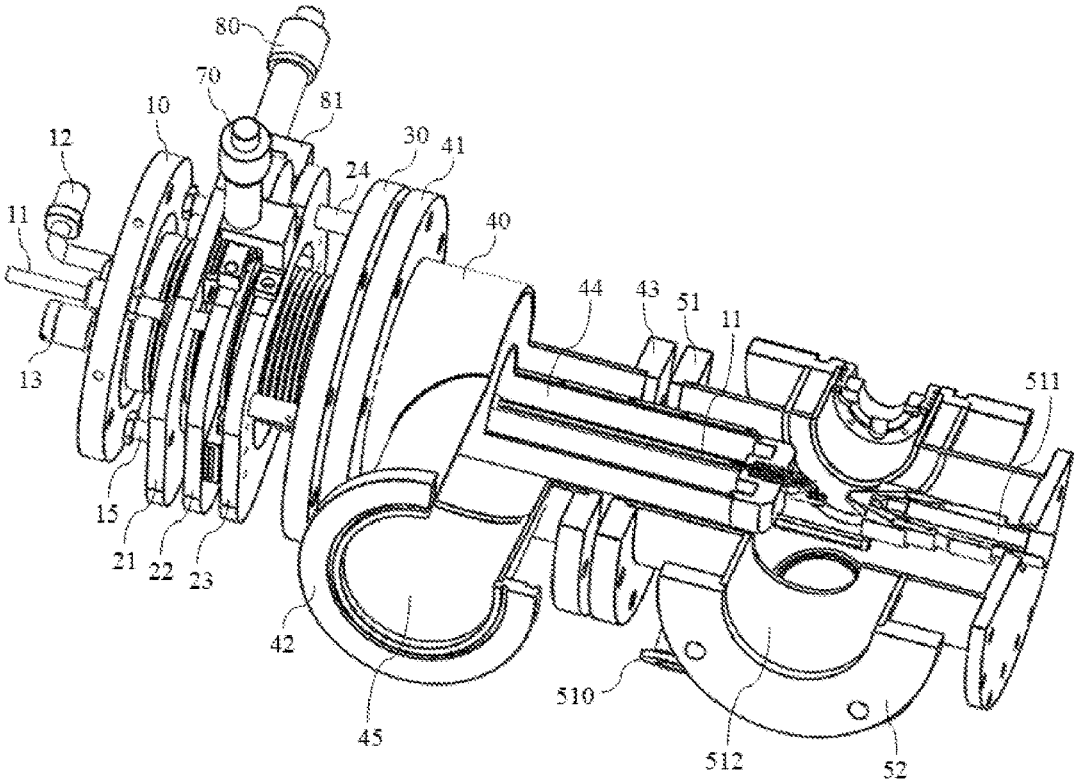
FIG. 3 is a schematically, partially cross-sectional perspective view of the soft X-ray light source according to FIG. 1.
Figure 5:
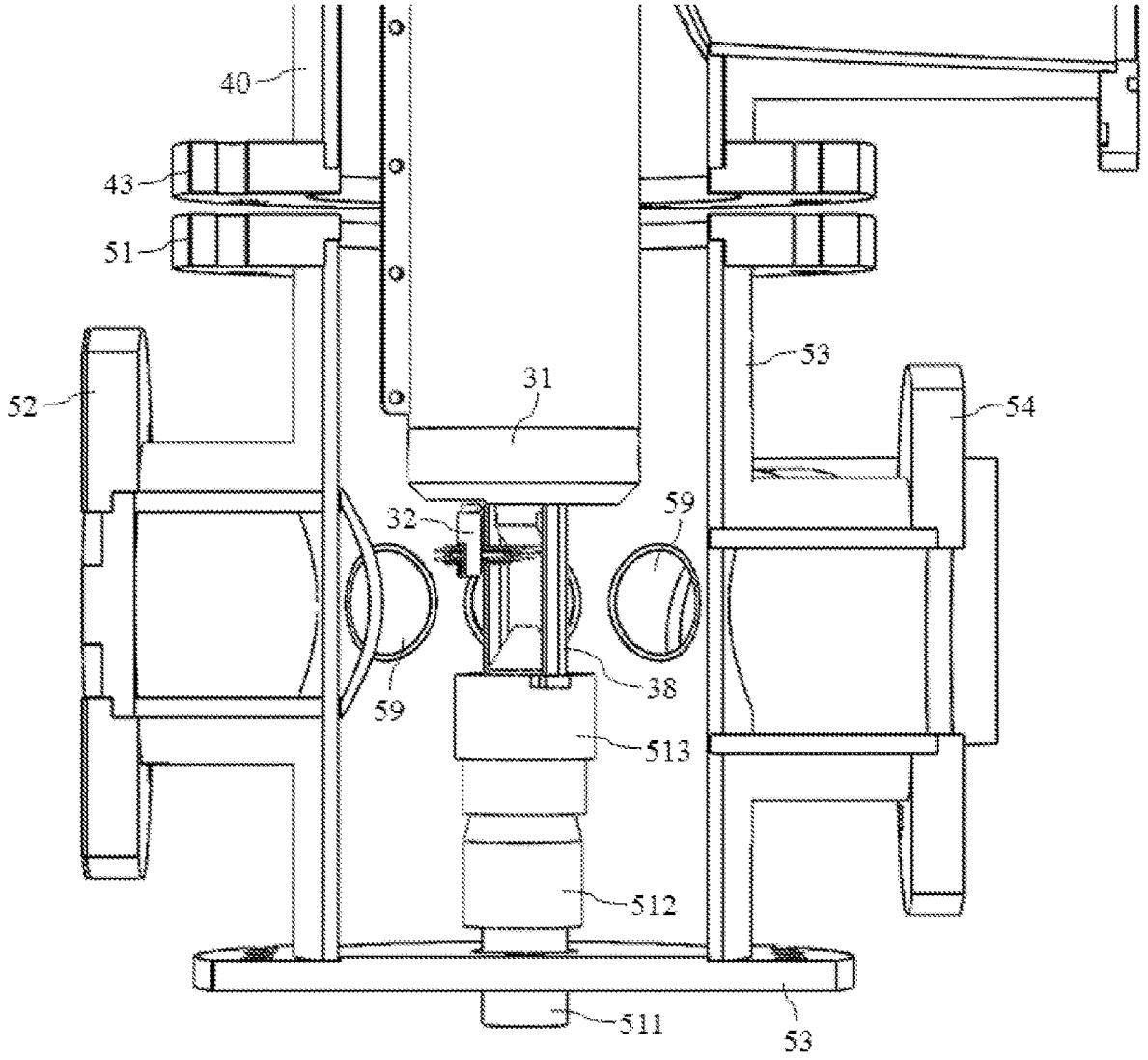
FIG. 5 is a schematic cross-sectional view of the soft X-ray light source according to FIG. 1, only with the lower portion being shown.

Further, FIG. 3 is a schematically, partially cross-sectional perspective view of the soft X-ray light source according to FIG. 1. FIG. 4 is a schematically cross-sectional view of the soft X-ray light source according to FIG. 1. FIG. 5 is a schematically cross-sectional view of the soft X-ray light source according to FIG. 1. Referring to FIG. 4 and FIG. 5 in combination with FIG. 3, the mounting plate 10 is also provided with the working gas pipe 11, the refrigerant outlet pipe 12, and the refrigerant inlet pipe 13, which pass through the mounting plate 10 from the outside and are inserted into the bellows 60. The refrigeration mechanism comprises a refrigeration cavity 44 which may be in form of a cylindrical shape and is received in the vacuum target chamber, a refrigerant inlet pipe 13, and a refrigerant outlet pipe 12. Specifically, the refrigeration cavity 44 extends from the inside of the t-branch tube 40 into the inside of the multi-channel tube 50, and the refrigerant inlet pipe 13 and the refrigerant outlet pipe 12 respectively pass from the top of the mounting plate 10 through the inside of the bellows 60 and through the first flange 30 and the second flange 41, and are in turn in communication with and fastened to the top of the refrigeration cavity 44, such that the refrigerant can be delivered from the refrigerant inlet pipe 13 into the refrigeration cavity 44 to reduce the temperature in the refrigeration cavity 44, while a gas generated in the refrigeration cavity 44 is discharged from the refrigeration cavity 44 through the refrigerant outlet pipe 12. The working gas pipe 11 passes from the top of the mounting plate through the inside of the bellows 60, the first flange 30, the second flange 41, and the refrigeration cavity 44, and after passing through the refrigeration cavity 44, the working gas pipe 11 is then connected to the nozzle. The working gas pipe 11 has a middle section forming a condensing cavity 111 with an enlarged cross-sectional area at least partially located in the refrigeration cavity 44. It should be noted that the inner portion of the working gas pipe 11 is not in communication with the inner portion of the refrigeration cavity 44. The working gas, such as nitrogen is delivered to the nozzle through the working gas pipe 11 and is liquefied in the process, such that the working gas has been liquefied when outflowing from the nozzle. The water moisture in the working gas is condensed when passing through the condensing cavity 11, such that purity of the proceeding working gas is maintained to prevent the nozzle from being clogged.

Figure 6:
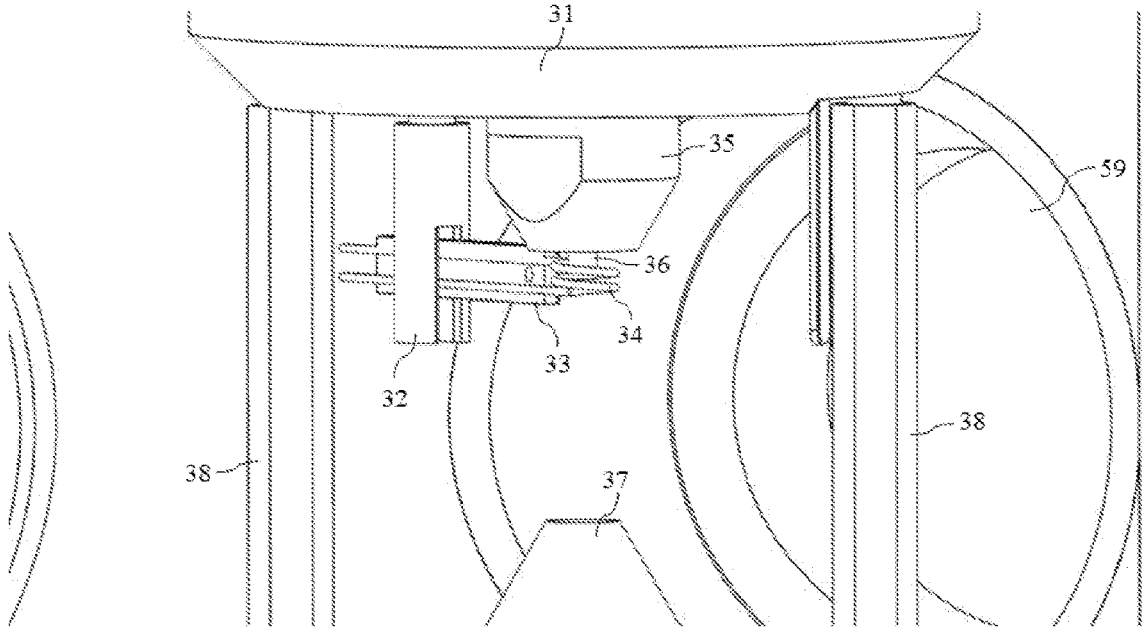
FIG. 6 is a schematically, partially enlarged perspective view of the soft X-ray light source according to FIG. 5, showing the nozzle and the heating device.

FIG. 6 is a schematically, partially enlarged perspective view of the soft X-ray light source according to FIG. 5. As shown in FIG. 6 in combination with FIG. 3, the light-generating mechanism comprises a nozzle 36 arranged under the refrigeration cavity 44 and fastened thereto by an adapter 35. The nozzle 36 is in communication with the working gas pipe 11, such that the working gas that has been condensed into liquid flows out of the nozzle 36. The adapter 35 generally is in form of a metal adapter for a rapid and accurate temperature transfer. Arranged at the periphery of the adapter 35 is a temperature sensor 31 for monitoring the temperature variation surround the nozzle 36 in real time, which temperature sensor is connected to an external device by means of one of the plugs 17 provided on the top of the mounting plate 10. Arranged below the refrigeration cavity 44 is connection piece 32 provided with a resistance wire holder 33 on which a resistance wire 34 is arranged, with a portion of the resistance wire in a form of a spiral surrounding the side face of the nozzle 36. The resistance wire 34 is connected to another plug 17 provided on the top of the mounting plate 10 by means of a conductive wire, to facilitate power supply to the resistance wire. The heating of the resistance wire 34 can compensate the temperature drop caused by the evaporation and condensation of the refrigerant liquid, but will not destroy the high-degree vacuum of the surrounding environment of the cryogenic liquid, such that the stability of the micro-liquid flow is further improved, and at the same time, when the nozzle 36 is blocked by condensation, the heating of the resistance wire 34 will facilitate declogging. Provided below the nozzle, substantially at a distance of 15 mm, is a metal frustum 37 which at its top has a groove in communication with a hollowed internal portion of the metal frustum 37, for receiving the residual liquid outflowing from the nozzle 36. The metal frustum 37 is designed to timely evacuate the residual liquid that has a great influence on the vacuum degree due to evaporation thereof, so as to reduce the consumption of soft X-rays. The lower part of the metal frustum 37 is further connected to the vacuum exhaust port 511 by means of a metal adapter 513 and a metal connector 512, such that the above-mentioned residual liquid may be drawn out through the vacuum exhaust port 511. It should be noted that the metal adapter 513 is also provided with a heat conduction rod 38 extending in the Z-axis direction and connected to the refrigeration cavity 44 to equilibrate the temperatures of the metal adapter 513, the metal frustum 37 and the nozzle 36 by means of heat transfer, such that it is assured the residual liquid will not change its state due to temperature variation, which will otherwise reduce the vacuum degree in the vacuum target chamber and affects the brightness of the soft X-rays. Or, the metal adapter 513 is provided with a heat conduction tube 38 extending in the Z-axis direction and connected to the refrigeration cavity 44, such that the refrigerant in the refrigeration cavity 44 can be delivered to the metal adapter 513 and the metal frustum 37 to equilibrate their temperatures and that in the refrigeration cavity 44, in order to prevent the cryogenic liquid micro-stream from further vaporizing during the flow process, which will otherwise reduce the vacuum degree in the vacuum target chamber and lead to consumption of the soft X-rays.

Since the nozzle 36 is fastened to the refrigeration cavity 44 which is in turn fastened to the mounting plate 10 by the refrigerant inlet pipe 13, the refrigerant outlet pipe 12, and the working gas pipe 11, the multi-axis adjustment of the geometric position of the nozzle 36 may be realized by the first displacement adjuster 70, the second displacement adjuster 80 and the third displacement adjuster 14, such that the nozzle in the vacuum target chamber may be adjusted in the X-, Y-, and Z-axis directions during the operation of the light source, such that the position of the liquid micro-flow may be controlled and ultimately, the purpose of adjusting the position of the soft X-ray light source may be realized.

Figure 7:
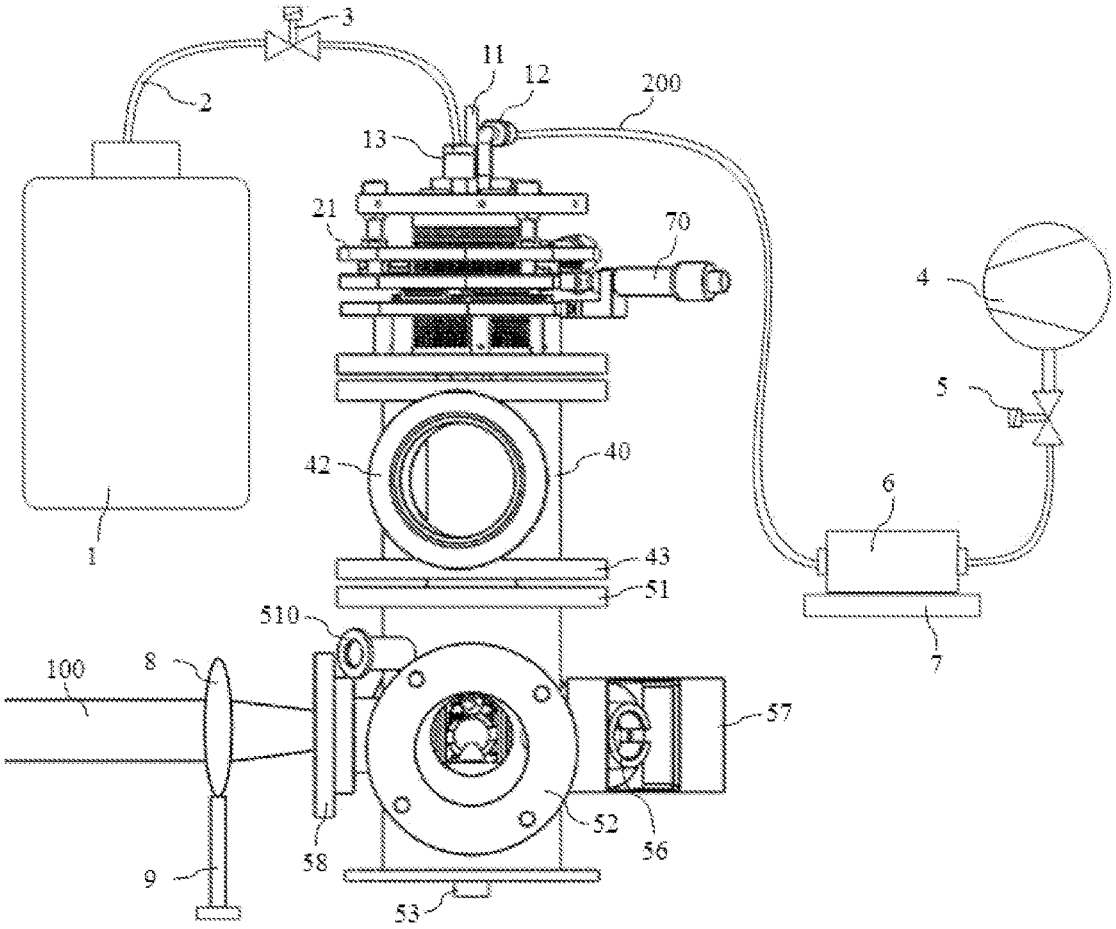
FIG. 7 is a schematic view of the external device connected to the soft X-ray light source according to FIG. 1.

FIG. 7 is a schematic figure of the external device connected to the soft X-ray light source according to FIG. 1. As shown in FIG. 7, the soft X-ray light source also comprises a refrigerant reservoir 1 connected to a refrigerant inlet pipe 13 through a delivery pipe 2 which is provided with a low-temperature solenoid valve 3 for automatically controlling the input of refrigerant and maintain the stable pressure in the refrigeration cavity. The soft X-ray light source further comprises a molecular vacuum pump 4 connected to the refrigerant outlet pipe 12 through a vacuum delivery tube 200 which is provided with a high-temperature buffer cavity 6 with a heater 7. Arranged between the high-temperature buffer cavity 6 and the molecular vacuum pump 4 is a vacuum solenoid valve 5. By heating the extracted low-temperature refrigerant by means of the high-temperature buffer cavity 6 and the heater 7, the refrigerant of excessively low temperature is prevented from damaging the vacuum solenoid valve 5 and the molecular vacuum pump 4. The vacuum solenoid valve 5 may be configured to set a vacuum threshold, so as to be closed when the pressure in the refrigeration cavity is too low and to be opened when the pressure in the refrigeration cavity is too high, such that the control of the temperature in the refrigeration cavity may be realized. The refrigerant within the refrigeration cavity 44 may be circulated and replaced by means of the molecular vacuum pump 4, such that a relatively low refrigeration temperature may be realized at the nozzle and can be precisely adjusted with a higher refrigeration efficiency, such that certain gases with an extremely low liquefaction point, such as nitrogen may be liquefied, and a more stable spray with a longer spray distance may be achieved, such that the soft X-ray light source is more stable and is applicable to various types of gas targets. The multi-channel tube 50 is also provided with a vacuum gauge interface 510 on the side face thereof, and a vacuum gauge is connected to the multi-channel tube 50 through the vacuum gauge interface 510 to measure the vacuum degree within the multi-channel tube 50. The light-generating mechanism also comprises a high-energy laser pulse generator with an entrance arranged at one of the exits on the side face of the multi-channel tube 50. Arranged over the exit is a laser focusing lens 8 for allowing the high-energy laser pulses 100 to be focused at the nozzle 36 within the multi-channel tube 50 and impact on the liquid micro-flow, such that the liquid micro-flow is plasmonized and soft X-rays are generated. In order to maintain the vacuum degree in the multi-channel tube 50 and the t-branch tube 40, the third flange 42 on the t-branch tube 40 and the vacuum exhaust port 511 at the bottom of the multi-channel tube 50 are connected to a vacuum extraction device. Considering that the vacuum extraction outlets are respectively located at the upper and lower ends of the vacuum target chamber, such that the vacuum degree in the vacuum target chamber can be maintained at a high level.

It should be noted by those skilled in the art that the first displacement adjuster and the second displacement adjuster mentioned in the technical solutions in the present application may be micrometer heads, and the third displacement adjuster may be replaced by other stepping devices, that is, any adjustment devices capable of manual or automatic adjustment of linear displacement with micron accuracy, such as an electric displacement table, which fall within the scope of the invention. It should be noted by those skilled in the art that the nozzle may be made of low-temperature resistant glass nozzles, and the adapter components, the adapters, and the metal frustum may be made of low-temperature resistant metal materials. The high-energy laser pulse may be generated by a high-energy nanosecond pulse laser device or may be generated by other high-energy short-pulse laser light sources, such as a femtosecond pulse laser device or the like, which will not be elaborated here. The vacuum pump in the disclosure may be selected from any of the ion pump, the roots pump, and the like, so as to achieve high-degree vacuum in the vacuum target chamber. The working gas is preferably nitrogen. However, nitrogen is only one of the target substances for generating laser plasma. Any other substance, including gas or liquid, which is able to generate laser plasma that radiates soft X-rays of a certain intensity, such as alcohol, xenon, and other substances, will fall within the scope of the invention.

What has been described above is only preferred embodiments in the disclosure and is not intended to limit the scope of the invention. Various alternatives may be made to the said embodiments in the disclosure. In this regard, any simple or equivalent change or modification made according to the claims and the description falls within the scope of the invention as prescribed in the claims. What is not described in detail in the disclosure is conventional.

What is claimed is:

1. A soft X-ray light source, comprising a vacuum target chamber, a refrigeration cavity, and a nozzle, wherein the refrigeration cavity and the nozzle are received in the vacuum target chamber, and the nozzle is arranged in the refrigeration cavity, characterized in that the vacuum target chamber comprises:

a t-branch tube, having a first outlet and a second outlet opposed to each other as well as a third outlet located between the first outlet and the second outlet, wherein the first outlet is connected to a mounting plate through which a refrigerant inlet pipe, a refrigerant outlet pipe, and a working gas pipe respectively pass and are connected to the refrigeration cavity, and wherein the third outlet is connected to a vacuum extraction device; and a multi-channel tube, comprising a top opening and a bottom opening opposed to each other as well as a plurality of side openings located between the top opening and the bottom opening, wherein the top opening is tightly connected to the second outlet, wherein a vacuum outlet is provided at the bottom opening, wherein the nozzle has a position corresponding to those of the side openings, wherein provided under the nozzle is a groove which is fixed by an adapter arranged at the vacuum outlet, and wherein the groove is in communication with the vacuum outlet.

2. The soft X-ray light source according to claim 1, wherein arranged below the refrigeration cavity is an adapter connected to the nozzle.

3. The soft X-ray light source according to claim 1, wherein a temperature sensor is provided at the nozzle.

4. The soft X-ray light source according to claim 1, wherein the adapter is provided with a heat conduction rod connected to the refrigeration cavity.

5. The soft X-ray light source according to claim 1, wherein the adapter is provided with a heat conduction tube in communication with the refrigeration cavity.

6. The soft X-ray light source according to claim 1, wherein the groove is provided on a top portion of a frustum fixedly connected to the adapter.

7. The soft X-ray light source according to claim 1, wherein a heater is provided at the periphery of the nozzle.

8. The soft X-ray light source according to claim 1, wherein the soft X-ray light source further comprises:

a mounting plate arranged above the vacuum target chamber and provided with a refrigerant inlet pipe, a refrigerant outlet pipe, and a working gas pipe passing through the mounting plate, wherein the refrigerant inlet pipe and the refrigerant outlet pipe are in communication with the refrigeration cavity, and the working gas pipe passes through the refrigeration cavity and is connected to the nozzle;

a bellows arranged between the mounting plate and the vacuum target chamber, wherein the refrigerant inlet pipe, the refrigerant outlet pipe and the working gas pipe all pass through the bellows; and a three-dimensional displacement mechanism arranged between the mounting plate and the vacuum target chamber.

9. The soft X-ray light source according to claim 8, wherein the three-dimensional displacement mechanism comprises a first displacement adjuster, a second displacement adjuster, and a third displacement adjuster, which are arranged between the mounting plate and the vacuum target chamber and respectively, control the movements of the mounting plate in three mutually perpendicular directions.

10. The soft X-ray light source according to claim 9, wherein the soft X-ray light source further comprises a first mounting plate, a second mounting plate, and a third mounting plate arranged in parallel with each other and sleeved about the bellows, wherein the first mounting plate is movably fastened to the mounting plate by the third displacement adjuster, the second mounting plate is movably fastened to the first mounting plate by the second displacement adjuster and is movably fastened to the third mounting plate by the first displacement adjuster, and the third mounting plate fastened to the vacuum target chamber.

11. The soft X-ray light source according to claim 10, wherein the first displacement adjuster comprises a first bracket fastened to the third mounting plate, a first pusher fastened to the first mounting plate and aligned with the second mounting plate, a first rail fastened to the third mounting in a first direction, and a first rail groove fastened to the underside of the second mounting plate and in slidable cooperation with the first rail.

12. The soft X-ray light source according to claim 11, wherein the second displacement adjuster comprises a second bracket fastened to the second mounting plate, a second pusher fastened to the second mounting plate and aligned with the first mounting plate, a second rail fastened to the second mounting in a second direction perpendicular to the first direction, and a second rail groove fastened to the underside of the first mounting plate and in slidable cooperation with the second rail.

13. The soft X-ray light source according to claim 12, wherein the first displacement adjuster comprises a plurality of screws fastened to the first mounting plate and evenly arranged in a third direction perpendicular to the first direction and the second direction, and a plurality of nuts, wherein the mounting plate is fastened to the screws by engagement of the nuts and the screws.

14. The soft X-ray light source according to claim 12, wherein the first displacement adjuster has a plurality of stepping devices arranged in a third direction perpendicular to the first direction and the second direction, wherein the mounting plate is fastened to the first mounting plate by the stepping devices.

15. The soft X-ray light source according to claim 12, wherein the first pusher or the second pusher has a micrometer head.

16. The soft X-ray light source according to claim 11, wherein the first pusher has a micrometer head.

17. The soft X-ray light source according to claim 1, wherein the working gas pipe has a section forming a condensing cavity with an enlarged cross-sectional area, wherein the condensing cavity is at least partially located in the refrigeration cavity.

* * * * *